US005084989A

United States Patent [19]

Theurer et al.

[11] Patent Number: 5,084,989

[45] Date of Patent: Feb. 4, 1992

[54] MOBILE BALLAST PLOW

[75] Inventors: Josef Theurer, Vienna; Herbert Wörgötter, Linz, both of Austria

[73] Assignee: Franz Plasser Bahnbaumaschinen-Industriegesellschaft m.b.H., Vienna, Austria

[21] Appl. No.: 666,723

[22] Filed: Mar. 8, 1991

[30] Foreign Application Priority Data

Mar. 21, 1990 [AT] Austria ..... A 669/90

[51] Int. Cl.[5] ..... E02F 5/22

[52] U.S. Cl. ..... 37/104; 104/279; 171/16

[58] Field of Search ..... 37/104, 105, 106, 107; 104/2, 279; 171/16

[56] References Cited

U.S. PATENT DOCUMENTS 3,491,467 1/1970 Finger .
3,651,587 3/1972 Plasser et al. .
3,877,160 4/1975 Plasser et al. .
4,227,324 10/1980 Theurer ..... 37/104
4,236,452 12/1980 Theurer et al. ..... 37/104 X
4,635,664 1/1987 Theurer et al. ..... 37/107 X
4,770,104 9/1988 Theurer ..... 37/104 X
4,794,862 1/1989 Theurer ..... 37/104 X
4,835,887 6/1989 Theurer ..... 37/104
4,967,847 11/1990 Whitaker, Jr. ..... 37/104 X

*Primary Examiner*—Randolph A. Reese
*Assistant Examiner*—J. Russell McBee
*Attorney, Agent, or Firm*—Collard, Roe & Galgano

[57] ABSTRACT

A mobile ballast regulator comprises a machine frame supported by two undercarriages for mobility on the track in an operating direction, a ballast plow carrier frame arranged below the machine frame between the undercarriages and extending in the longitudinal direction, the carrier frame having one end linked to the machine frame and an opposite end supported by an undercarriage for mobility on the track, and a ballast plow vertically adjustably mounted on the carrier frame.

6 Claims, 1 Drawing Sheet

MOBILE BALLAST PLOW

BACKGROUND OF THE INVENTION

1. Field of the Invention

The present invention relates to a mobile machine for distributing and shaping ballast supporting a railroad track extending in a longitudinal direction, which comprises a machine frame supported by two undercarriages for mobility on the track in an operating direction, and a vertically adjustable ballast plow arranged below the machine frame between the undercarriages.

2. Description of the Prior Art

The ballast regulator disclosed in U. S. Pat. No. 3,651,587, dated Mar. 28, 1972, has two ballast plow halves respectively associated with the two rails of a railroad track. The ballast plow halves project from the front end of the machine frame and are vertically displaceable along a vertical guide so the plowshares extending across the entire track are individually adjustable along the respective track rails.

U.S. Pat. No. 3,877,160, dated Apr. 15, 1975, discloses a self-propelled ballast regulator whose machine frame is supported on the track by undercarriages and which carries a vertically adjustable ballast plow underneath an operator's cab between the two undercarriages. The ballast plow comprises ballast guiding plowshares in an X-formation and tunnel-shaped cover elements extending over the track rails. The plow has three ballast deflecting plates pivotal about a vertical axis at the center.

In the mobile ballast distributing and planing machine of U.S. Pat. No. 3,491,467, dated Jan. 27, 1970, two ballast plow halves associated with the track rails are linked to the rear of the machine frame by a parallelogram actuating mechanism. Each plow half is supported on the associated rail by a roller and is vertically adjustable.

SUMMARY OF THE INVENTION

It is the primary object of this invention to improve a ballast regulator of the indicated type so that it may be operated without difficulty in track curves.

The above and other objects are accomplished according to the invention with a mobile machine for distributing and shaping ballast supporting a railroad track extending in a longitudinal direction, which comprises a machine frame supported by two undercarriages for mobility on the track in an operating direction, a ballast plow carrier frame arranged below the machine frame between the undercarriages and extending in the longitudinal direction, the carrier frame having one end linked to the machine frame and an opposite end supported by an undercarriage for mobility on the track, and a ballast plow vertically adjustably mounted on the carrier frame.

A ballast plow carried on such a carrier frame will be automatically centered with respect to the track rails even in sharp curves because the undercarriage supporting the front end of the carrier frame will guide it along the track. Therefore, the plow will be able to distribute ballast to the intersections of the ties and rails, where the track is supported on the ballast bed and the ballast is required, even in sharp curves. Furthermore, this independent support of the ballast plow on a carrier frame enables the machine frame to have a longer wheelbase, thus making it possible, for example, to mount a large ballast storage container on the correspondingly elongated machine frame. In addition, the independent mounting of the ballast plow on a carrier frame makes it possible to use the section of the machine frame above the ballast plow for mounting other equipment, such as a bottom conveyor for the ballast storage container. Finally, the undercarriage supporting the ballast plow carrier frame on the track advantageously reduces the pressure on the axles of the undercarriages supporting the machine frame on the track.

Preferably, the undercarriage supporting the opposite end of the carrier frame is arranged immediately preceding the ballast plow in the operating direction. The closeness of the ballast plow to the undercarriage guiding the carrier frame along the track assures the exact centering of the ballast plow with respect to the track rails even in the sharpest curves. Furthermore, since the undercarriage precedes the plow, the ballast flow across the rails caused by the plow will not disturb the contact of the undercarriage wheels with the rails. Since the plow is mounted on the carrier frame between its ends respectively linked to the machine frame and supported on the track, the carrier frame may be relatively short, the weight of the ballast plow being distributed to the machine frame and the undercarriage.

The ballast plow preferably comprises a center plow for shaping a center portion of the ballast, and vertically and transversely adjustable shoulder plowshares arranged at respective sides of the carrier frame and preceding the center plow in the operating direction. This makes it possible to adjust the shoulder plows with respect to the center plow independently of any track curves so that the ballast bed will be uniformly shaped, regardless of the curvature of the track.

The undercarriage supporting the opposite end of the carrier frame is preferably substantially centered between the two undercarriages supporting the machine frame. This enables the ballast plow to be sufficiently spaced from the rear undercarriage supporting the machine frame on the track while, on the other hand, avoiding an undue length of the carrier frame, which would increase its weight.

According to a preferred embodiment of the invention, a lifting device links the carrier frame to the machine frame in the range of the undercarriage supporting the opposite carrier frame end. This enables the carrier frame with the ballast plow to be readily raised off the track during transit of the machine between operating sites.

In another preferred embodiment, a pressure device is arranged between the machine frame and the carrier frame, the pressure device being connected to the carrier frame for pressing the carrier frame away from the machine frame. Pressing the carrier frame and its undercarriage against the track rails will assure its running on the track without any problems even when an accumulation of ballast is produced by the trailing ballast plow, which would tend to press the forward end of the carrier frame upwardly.

BRIEF DESCRIPTION OF THE DRAWING

The above and other objects, advantages and features of the present invention will become more apparent from the following description of a now preferred embodiment thereof, taken in conjunction with the accompanying, somewhat schematic drawing wherein.

DETAILED DESCRIPTION OF PREFERRED EMBODIMENT

Figure 1:
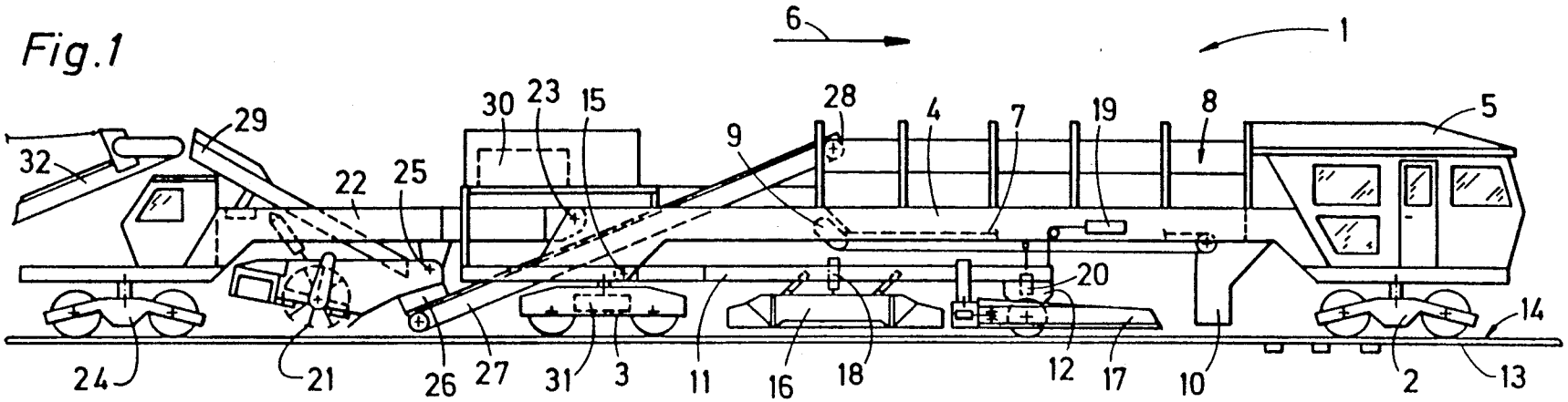
FIG. 1 is a side elevational view of a ballast regulator according to this invention.
Figure 2:
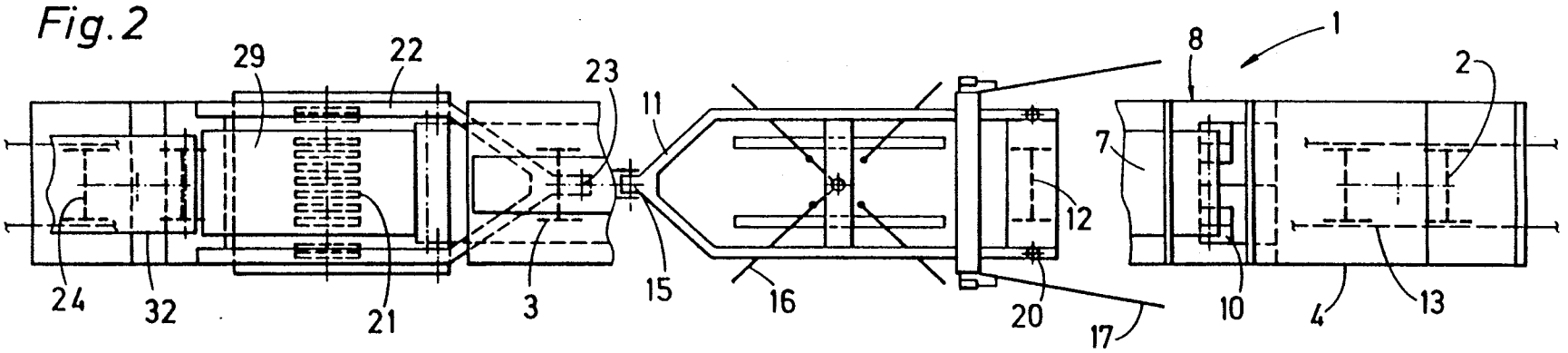
FIG. 2 is a diagrammatically simplified top view of the ballast regulator.

The drawing shows mobile machine 1 for distributing and shaping ballast supporting railroad track 14 extending in a longitudinal direction, which comprises machine frame 4 supported by two undercarriages 2, 3 for mobility on the track in an operating direction indicated by arrow 6. Operator's cab 5 is mounted on a front end of machine frame 4, and the machine frame further supports elongated ballast storage container 8 extending between the undercarriages and having bottom conveyor band 7 driven by drive 9 for conveying ballast stored in the container towards four ballast discharge chutes 10 which are arranged to discharge ballast at the field and gage sides of track rails 13.

Ballast plow carrier frame 11 is arranged below machine frame 4 between undercarriages 2, 3 and extends in the longitudinal direction. The carrier frame has one end 15 linked to the machine frame and an opposite end supported by undercarriage 12 for mobility on track 14. Ballast plow 16, 17 is vertically adjustably mounted on the carrier frame. Carrier frame end 15 is pivotal about axes extending vertically and transversely to the longitudinal direction. Center plow 16 for shaping a center portion of the ballast is connected to carrier frame 11 by vertical adjustment drive 18, and vertically and transversely adjustable shoulder plowshares 17 are arranged at respective sides of the carrier frame and precede the center plow in the operating direction.

As shown, undercarriage 12 supporting the opposite end of carrier frame 11 is arranged immediately preceding ballast plow 16, 17 in the operating direction, and is substantially centered between the two undercarriages 2, 3 supporting machine frame 4.

Lifting device 19 links carrier frame !1 to machine frame 4 in the range of undercarriage 12 supporting the opposite carrier frame end. The illustrated lifting device is a rope drive comprised of a rope trained over a pulley and a hydraulic cylinder whose piston is connected to one end of the rope while the opposite rope end is affixed to a front end of carrier frame 11. Furthermore, hydraulically operated pressure device 20 is arranged between machine frame 4 and carrier frame 11, the pressure device being connected to the carrier frame for pressing the carrier frame away from the machine frame. The downward pressure on the carrier frame counteracts any upward pressure exerted by a ballast accumulation produced by plow 16, 17 and thus prevents undercarriage 12 from being lifted off the track.

Illustrated ballast regulator 1 further comprises rotary ballast broom 21 extending transversely across track 14 at a rear end of machine frame 4 in the operating direction. The ballast broom is part of ballast sweeping arrangement vertically adjustably mounted on carrier frame 22 extending in the longitudinal direction of elongated machine frame 4 and having a leading end linked at 23 to the rear end of the machine frame while its rear end is supported on track 14 by undercarriage 24. Universal coupling 23 links the carrier frame to the machine frame so that carrier frame 22 may be pivoted about axes extending transversely as well as vertically to the longitudinal direction of elongate machine frame 4. Broom 21 has radially extending, flexible sweeping elements and is rotatable by a drive, and a hydraulic drive connects a housing of the broom to carrier frame 22 for vertical adjustment of the broom, the housing being pivoted to a bracket downwardly projecting from carrier frame 22 for pivoting about horizontal axis 25 extending transversely to the carrier frame. Upon rotation of broom 21 in a counter-clockwise direction, its flexible sweeping elements sweep ballast engaged thereby through the housing into chute 26, which discharges the swept-up ballast onto the input end of ascending conveyor 27 which conveys it to output end 28 whence the ballast is thrown into ballast storage container 8.

Downwardly inclined gutter 29 is mounted on carrier frame 22 above ballast broom 21 and extends in the longitudinal direction of the carrier frame from a rear input end to a forward output end which extends into the broom housing to deliver any required additional ballast into chute 26. When a long track section is surfaced with continuously advancing machine 1 and more ballast is required than is supplied to container 8 by ballast broom 21, additional ballast stored in a box car following machine 1 is conveyed by conveyor 32 to the input end of vibratory gutter 29 to move the ballast down the gutter into chute 26 whence it is conveyed into ballast storage container 8.

Another operator's cab is mounted on carrier frame 22 below the gutter input end for controlling the operation of ballast supply gutter 29 and ballast broom 21. Central power plant 30 supplies power to all operating drives of machine 1, including drive 31 for advancing the machine along the track.

Before a ballast regulating operation begins, ballast storage container 8 is filled, for example, by conveying ballast stored in a trailing silo car by conveyors 32 and 27 into the container where it is stored on bottom conveyor band 7. Some storage capacity is kept for enabling container 8 to receive any ballast swept up by broom 21 during the operation.

At the operating site, broom 21 and ballast plow 16, 17 are lowered into their respective operating positions, carrier frame 11 is lowered by operation of device 19 and pressed down by device 20, and machine 1 is advanced continually in the operating direction indicated by arrow 6. Any excess ballast accumulating on the track is swept up by rotating broom 21 and is conveyed by ascending conveyor 27 into ballast storage container 8. When the operator in cab 5 determines that track 14 requires additional ballast, the discharge ports of all or selected chutes 10 are opened and bottom conveyor 7 is driven a short distance to discharge stored ballast from container 8 onto the track. If the ballast storage container is emptied during the operation, it can be refilled from a trailing silo car at any time by the above-described operation of conveyors 32 and 27.

What is claimed is:

1. A mobile machine for distributing and shaping ballast supporting a railroad track extending in a longitudinal direction, which comprises (a) a machine frame supported by two undercarriages for mobility on the track in an operating direction, (b) a ballast plow carrier frame arranged below the machine frame between the undercarriages and extending in the longitudinal direction, the carrier frame having one end linked to the machine frame and an opposite end supported by an undercarriage for mobility on the track, and (c) a ballast plow vertically adjustably mounted on the carrier frame.

2. The mobile machine of claim 1, wherein the undercarriage supporting the opposite end of the carrier frame is arranged immediately preceding the ballast plow in the operating direction.

3. The mobile machine of claim 1, wherein the ballast plow comprises a center plow for shaping a center portion of the ballast, and vertically and transversely adjustable shoulder plowshares arranged at respective sides of the carrier frame and preceding the center plow in the operating direction.

4. The mobile machine of claim 1, wherein the undercarriage supporting the opposite end of the carrier frame is substantially centered between the two undercarriages supporting the machine frame.

5. The mobile machine of claim 1, further comprising a lifting device linking the carrier frame to the machine frame in the range of the undercarriage supporting the opposite carrier frame end.

6. The mobile machine of claim 1, further comprising a pressure device arranged between the machine frame and the carrier frame, the pressure device being connected to the carrier frame for pressing the carrier frame away from the machine frame.

* * * * *